US005501299A

United States Patent [19]

Holmes

[11] Patent Number: 5,501,299

[45] Date of Patent: Mar. 26, 1996

[54] PROCESS AND APPARATUS FOR PREVENTING CORROSION OF A HYDRAULIC ELEVATOR CYLINDER

[75] Inventor: William K. Holmes, San Diego, Calif.

[73] Assignee: U.S. Elevator, El Cajon, Calif.

[21] Appl. No.: 177,424

[22] Filed: Jan. 5, 1994

[51] Int. Cl.[6] ..... B66B 9/04

[52] U.S. Cl. ..... 187/272; 187/414; 92/144; 405/211.1; 405/216

[58] Field of Search ..... 187/272, 275, 187/414; 73/323; 92/144; 405/211.1, 216

[56] References Cited

U.S. PATENT DOCUMENTS

| | | | |
|---|---|---|---|
| 2,933,068 | 4/1960 | Johnson et al. | 92/144 X |
| 3,630,037 | 12/1971 | Howard . | |
| 3,956,934 | 5/1976 | White | 73/323 |
| 4,565,468 | 1/1986 | Crawford . | |
| 4,792,289 | 12/1988 | Nieratschker | 92/144 X |
| 5,076,146 | 12/1991 | Bialy et al. . | |
| 5,105,664 | 4/1992 | Wagner | 73/323 X |

FOREIGN PATENT DOCUMENTS

| | | | |
|---|---|---|---|
| 2125880 | 9/1972 | France . | |
| 57-193618 | 11/1982 | Japan | 405/216 X |
| 2182687 | 7/1990 | Japan | 187/272 X |
| 1546710 | 5/1979 | United Kingdom . | |
| 2255583 | 11/1992 | United Kingdom | 405/216 X |

*Primary Examiner*—William E. Terrell
*Assistant Examiner*—Dean A. Reichard
*Attorney, Agent, or Firm*—Brown, Martin Haller & McClain

[57] ABSTRACT

The surface of a hydraulic cylinder is enclosed with a cylindrical casing. A fluid, preferably a thixotropic dielectric hydrophobic fluid which retains a gel structure when static, has a specific gravity greater than water and inhibits bacteriogenic and aqueous corrosion fills the annular space between the cylinder surface and the casing, preventing water that may be rich in bacteria, from reaching the cylinder surface. A fluid conduit between the annular space and a reservoir is provided and the fluid fills the reservoir to a predetermined level such that water, hydraulic fluid or another fluid in the system may be detected by a rise in the predetermined level. The water or hydraulic fluid can be easily removed as it will float on the top of the fluid in the reservoir.

34 Claims, 2 Drawing Sheets

PROCESS AND APPARATUS FOR PREVENTING CORROSION OF A HYDRAULIC ELEVATOR CYLINDER

BACKGROUND

1. Field of the Invention

The invention herein relates to a process and apparatus for preventing corrosion, and more particularly microbiologically influenced corrosion, as well as galvanic and water influenced corrosion, of a hydraulic elevator cylinder.

2. Background of the Invention

A hydraulic elevator shaft cylinder is normally constructed of steel and installed underground, thus exposing the cylinder to soil and ground water. As a result, corrosion of various types may occur. Because the cylinder is installed beneath the elevator car frame and platform, and typically beneath the building, any repair or replacement of a corroded cylinder necessarily involves substantial difficulties in gaining access to the cylinder. Leakage of hydraulic fluid from a corroded or defective cylinder may create an environmentally hazardous situation.

While corrosion of various types, including water influenced and galvanic corrosion, are known to occur, of particular concern is microbiologically influenced corrosion caused by bacteria such as sulfate reducing bacteria and acid producing bacteria. This type of corrosion will occur when microbiologically rich ground water comes in contact with the cylinder and occurs substantially more rapidly than many other types of corrosion. Therefore, it is a particularly serious problem.

Examples of corrosion causing sulphate-reducing bacteria are those of the genus Desulfovibrio. Bacteria of the genus Gallionella are examples of acid producing bacteria also known to cause corrosion. Corrosion of simple metal pipes caused by these bacteria has been recognized and documented. However, no one has previously described any method for prevention of corrosion of hydraulic elevator cylinders caused by microorganisms.

A number of methods and devices, such as protective coatings and casings, have been utilized to deal with the problem of corrosion to hydraulic cylinders caused by the effects of salts, sulphur, stray currents and other causes. Typical examples are shown in U.S. Pat. Nos. 4,983,072; 5,076,146 and 5,226,751. However, these methods and devices are subject to failure as a result of damage occurring during transportation or installation or due to ground movement after the installation, when the casing may leak or the coating may become damaged, thus breaking the seal and exposing the cylinder to the underground environment of soil, water and bacteria. Additionally, these methods and devices have not addressed the problem of microbiologically influenced corrosion.

Techniques exist for detection and removal of fluid within a casing, such as sensing for the presence of a fluid by the use of pressure. However, such sensing means are located below ground and under cement so that failure of this system cannot be checked. Furthermore, this system does not prevent the growth of bacteria and the resulting damage to the cylinder and further does not prevent damage to the protective casing, caused by earth movement or other movement of the cylinder.

There is clearly a need for an efficient method and device to prevent corrosion, especially microbiologically influenced corrosion, of a cylinder of a hydraulic elevator and to detect the leakage of water into the casing surrounding the cylinder. Furthermore, there is a need for an efficient method to detect the leakage of hydraulic fluid from a corroded or defective cylinder into the casing surrounding the cylinder.

SUMMARY OF THE INVENTION

The present invention is directed to a process and apparatus that addresses the needs identified above and comprises protecting a hydraulic cylinder having a surface exposed to the underground environment against bacteriogenic, aqueous and galvanic corrosion.

The exposed cylinder surface is enclosed within a cylindrical casing with an annular space between the cylinder surface and the casing. The space is filled with a fluid, preferably a thixotropic, dielectric and hydrophobic fluid which retains a gel structure when static, has a specific gravity greater than water and inhibits the bacteriogenic, aqueous and galvanic corrosion referred to above.

The invention further provides a fluid conduit between the annular space and a reservoir for the thixotropic hydrophobic fluid. The space and reservoir are filled with the fluid to a predetermined level. The presence of water or hydraulic fluid in the annular space can then be detected by observing the fluid reaching a level in the reservoir above the predetermined level. The water can be removed from the space and reservoir by drawing off water floating on top of the fluid in the reservoir.

DETAILED DESCRIPTION OF THE BEST MODE

Figure 1:
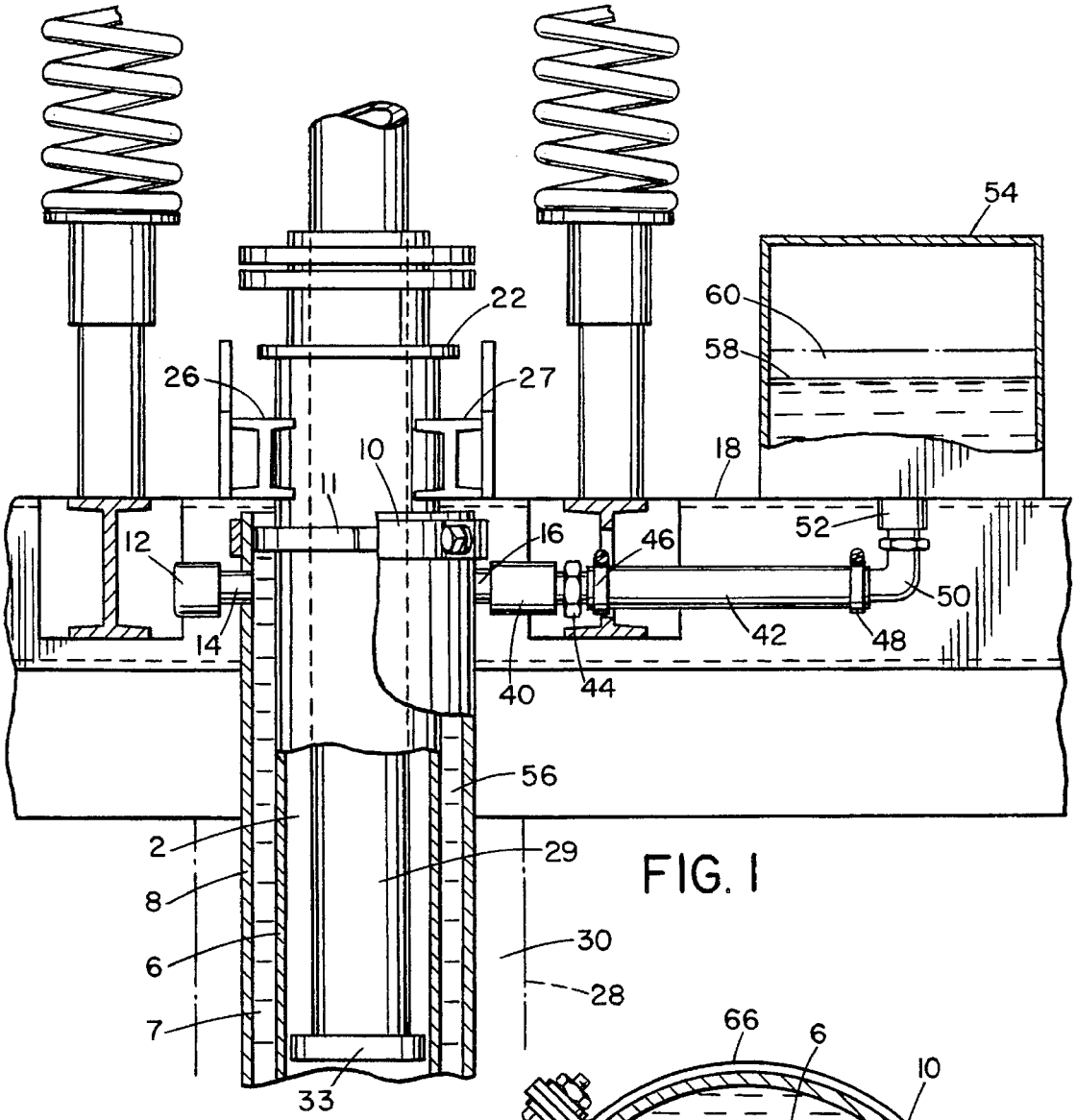
FIG. 1 is a side elevation view of the invention with parts cut away.
Figure 3:
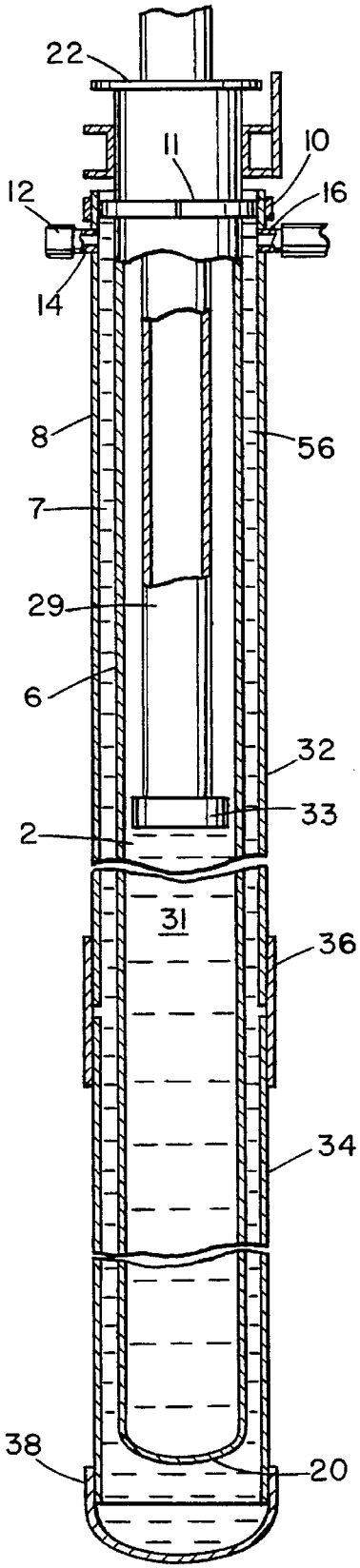
FIG. 3 is a longitudinal section, rotated 90°, of casing and clamp, taken along line 3—3 of FIG. 2.

Referring to the drawings, FIG. 1 illustrates an embodiment of an invention for prevention of corrosion, including microbiologically influenced corrosion, of a hydraulic cylinder 2, normally constructed of steel, and positioned underground beneath the elevator car frame and platform (not shown) and the steel support 18 for the cylinder 2. The cylinder, having a surface 6, has a closed end 20 (shown in FIG. 3) and an open end 22. The cylinder is supported by brackets 26 and 27 opposedly located on either side of the cylinder above the steel support 18 for the cylinder 2. Ram 29 is a smaller diameter than that of cylinder 2. Pressurized hydraulic fluid 31 is supplied to cylinder 2 to force the ram up so as to raise the elevator car (not shown). Alternatively, hydraulic fluid 31 is released to allow the elevator car to lower. A stop ring 33 prevents the ram from extending above or below a desired level in cylinder.

The cylinder extends downward within a drill hole 28 that is backfilled with dirt or sand 30.

Figure 2:
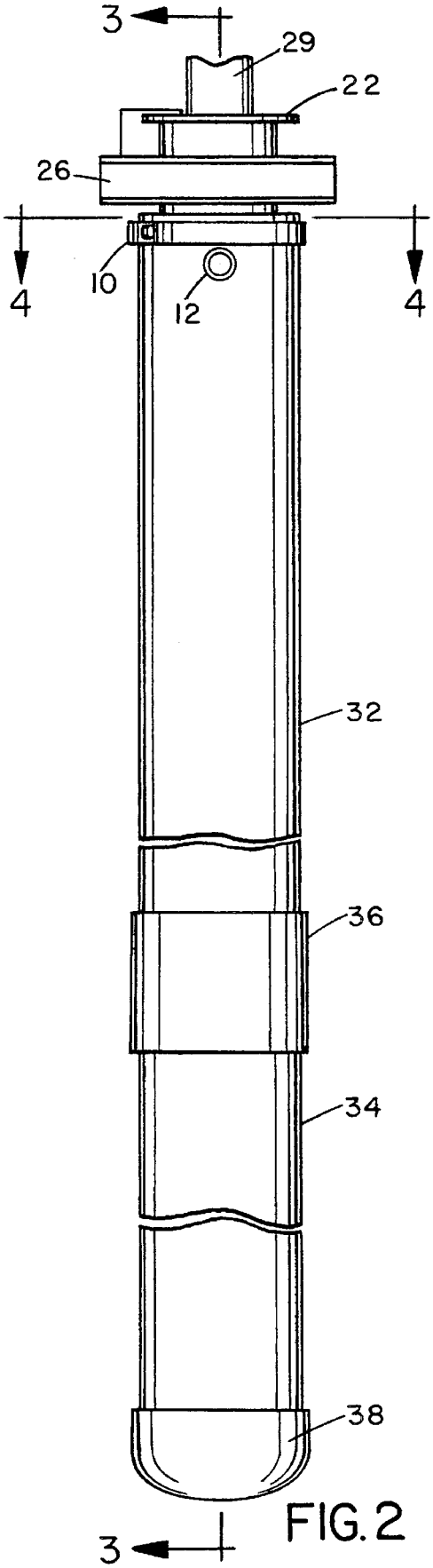
FIG. 2 is a side elevation view of the casing and the compression clamp.

A cylindrical casing 8 surrounds the cylinder along its length that is exposed to the underground environment. The casing may be constructed of one or more portions of tubing, 32 and 34, as shown in FIG. 2, joined using a socket or coupling 36 and having an end cap 38 as illustrated in FIG.

2. The casing is spaced apart from the cylinder along the axial length of both, forming an annular space 7 between the inner surface of the casing and the outer surface of the cylinder. The width of the annular space 7 is preferably about 0.50 to 0.75 in., but may be any convenient distance sufficiently great to permit the fluid to flow into and throughout the entire annular space.

The aforedescribed casing and fittings may be of any rigid material, but preferably will be made of a non-electrically-conductive inert material such as polyvinyl chloride (PVC). PVC tubing is readily available commercially in many diameters and is reasonably priced, and therefore is preferred in the present invention. Other types of non-conductive tubing, such as acrylonitrile-butadiene-styrene (ABS) and glass fiber reinforced polymeric tubing, may also conveniently be used. A number of suitable materials are described in Seymour, *Engineering Polymer Sourcebook* (McGraw-Hill: 1990) and Rubin, (ed.), *Handbook of Plastic Materials and Technology* (Wiley-Interscience: 1990).

Returning to FIG. 1, a compression clamp 10 and a seal 11 (described in more detail below) surround the cylinder and secure the top of the casing to cylinder. Below the clamp and seal an airbleed plug 12 caps nipple 14, with the nipple being inserted through the casing into the space between the casing and the cylinder 2, providing a space for air bleed. A PVC cement may be used to provide a better seal around said nipple.

Directly opposite but along the same plane as the aforesaid airbleed plug, a second nipple 16 is also inserted through the casing to provide a conduit between the annular space and a socket 40 which is further joined to flexible tubing 42 by a nipple 44 and hose clamp 46. At the opposite end the tube or hose 42 is attached to elbow 50 by another hose clamp 48. Elbow 50 is attached at fitting 52 to reservoir 54.

A fluid 56 pumped into reservoir 54 fills the annular space between the shaft cylinder and the casing, filling said reservoir to a predetermined level 58, (the level being within a range to allow for thermal expansion 60 of the fluid). The fluid 56 is a thixotropic, hydrophobic fluid which forms a stable gel when static and which has a specific gravity greater than that of water. This fluid functions to fill the entire volume of the annular space 7 between the outer surface of the shaft cylinder and the inner surface of the casing. Since the fluid when in the annular space is essentially static, its thixotropic character prevents it from flowing out of the casing through any minor penetration of the casing. Its hydrophobicity further inhibits the incursion of water from the surrounding soil even if the casing is subject to such minor penetration.

In addition, the hydrophobicity and the specific gravity of the fluid, as well as the minor motion within the fluid (as from thermal expansion and contraction or vibration from elevator and/or earth movements), serve to force any water or hydraulic fluid which does get into the space 7 up through the space 7 and hose or tube 42 to the reservoir 54, where the water or hydraulic fluid appears as a separate layer on top of the surface of the hydrophobic fluid 56. The water or hydraulic fluid may be readily detected by various conventional means, including sight glasses (such as glass 53), float gauges and capacitance-type electrical sensors; see Perry, ed., *Chemical Engineers' Handbook* (3rd edn.: 1950), pp. 1252–1253 and Perry et al., eds., *Chemical Engineers' Handbook* (5th edn., 1973), pp. 22–24 through 22–47. That aqueous layer can easily be removed, as by use of a suction tube, inserted through opening 55 which is normally closed by cover 57, thus keeping the space between the casing and the cylinder substantially free of water. In addition, any leakage of hydraulic fluid into space 7 will also be detected by a rise in the level of fluid in reservoir 54 and the presence of said hydraulic fluid on top of fluid 56 in reservoir.

Since the space 7 between the cylinder and the casing will be filled with the thixotropic, hydrophobic fluid and essentially free of water, nothing will support the presence corrosion-causing microorganisms, which need water to survive, so that corrosion of the cylinder's surface will be essentially eliminated.

It will also be desirable for the fluid 56 to have a biocidal character, to enhance the fluid's ability to keep microorganisms from becoming established within the annular space, and further for the fluid to be electrically insulating or di-electric, in order to inhibit galvanic corrosion of the cylinder. Also, of course, the fluid itself must not be corrosive to either the cylinder or the casing and preferably the fluid should be environmentally safe.

There are numerous polymeric fluids and fluid suspensions which can suitably be used in this invention. Typical examples are described in Barnes et al., *An Introduction to Rheology* (Elsevier: 1989), Ferguson et al., *Fluid Rheology* (Elsevier: 1991) and Walters (ed.), *Rheometry: Industrial Applications* (Research Studies Press: 1980). Typical of the useful fluids are the clay- and/or oil-based aqueous emulsions and suspensions, such as those described in Walters, supra, Chs. 3 and 7, and Ferguson et al., supra, Ch. 6, especially Section 6.5. A particularly preferred material is a proprietary thixotropic dielectric liquid product formed of a non-phytotoxic paraffin base petroleum oil, organophilic clay, and water (and including minor amounts of poly-fatty-acid esters and derivatives, calcium carbonate and lime), which is commercially available under the trade name "Union-Gard 160" from Pacific Standard Chemical Co. This product has a pH of 9 (slightly alkaline), a boiling point of 169° F. (76° C.), a specific gravity of 1.1, and has a light gray, opaque appearance.

Figure 4:
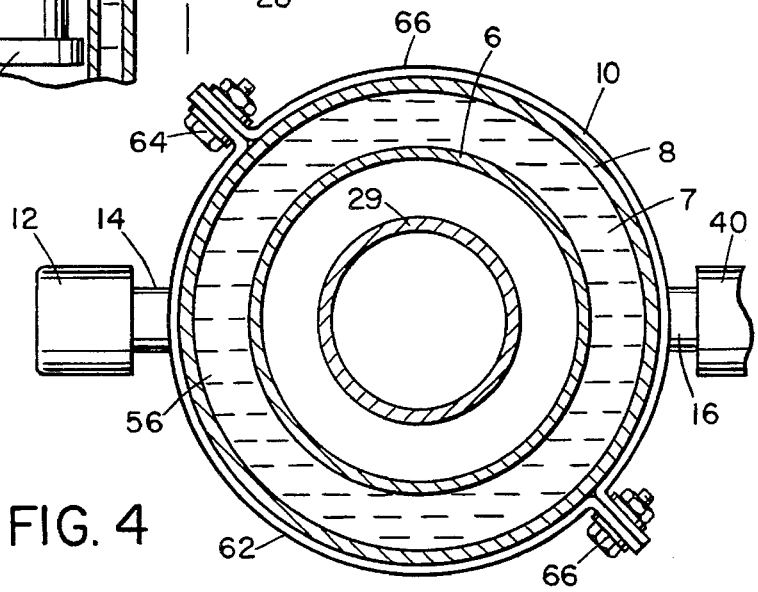
FIG. 4 is a cross-section taken along line 4—4, showing the clamp, the seal, the casing, the fluid filled space and the cylinder.

FIG. 4 shows a ring seal 11 surrounding the upper end 68 of cylinder 2 and filling the width of that portion of the space 7 between the cylinder 2 and the casing 8. On the outside of casing 8 and aligned with ring seal 11 is compression clamp 10, which is a two-piece adjustible clamp containing two adjusting bolts 64 and 66. The clamp 10 is tightened to compress the top of casing 8 and ring seal 10 against the top portion 68 of the cylinder 2 to seal the top of the space 7 against loss of the fluid.

It will be evident that there are numerous additional embodiments which are clearly within the scope and spirit of this invention but which have not been expressly described. Therefore the above description should be considered to be exemplary only, and the scope of the invention is to be detemined by reference to the appended claims.

What is claimed is:

1. A process for protecting a hydraulic cylinder having a surface exposed to an underground environment against biogenic and aqueous corrosion, comprising the steps of:

a. enclosing said cylinder surface exposed to said environment within a casing with a space between said cylinder surface and said casing;

b. substantially filling said space with a fluid;

c. providing a fluid conduit between said space and a reservoir for said fluid;

d. filling said space and that portion of said reservoir below a predetermined level with said fluid; and e. detecting the presence of water in said space by observation of said fluid reaching a level in said reservoir above said predetermined level.

2. A process in accordance with claim 1 wherein said fluid is a corrosion inhibiting fluid.

3. A process in accordance with claim 1 wherein said casing is generally cylindrical and said space is generally annular.

4. A process in accordance with claim 1 further comprising the step of:

removing water from said space and said reservoir by drawing off water floating on top of said fluid in said reservoir.

5. A process in accordance with claim 1 further comprising the step of:

detecting the presence of hydraulic fluid in said space by the observation of said fluid reaching a level in said reservoir above said pre-determined level and drawing off hydraulic fluid floating on top of said fluid in said reservoir.

6. A process in accordance with claim 1, wherein said detecting step includes compensating for normal expected variation in fluid level resulting from thermal expansion.

7. A process in accordance with claim 1 wherein said biogenic corrosion is caused by the presence of microorganisms in said water and wherein said fluid is biocidal.

8. A process for protecting a hydraulic cylinder having a surface exposed to an underground environment against biogenic and aqueous corrosion, comprising the steps of:

a. enclosing said cylinder surface exposed to said environment within a casing with a space between said cylinder surface and said casing;

b. substantially filling said space with a thixotropic hydrophobic fluid which retains a gel structure when static, has a specific gravity greater than water and inhibits said corrosion;

c. providing a fluid conduit between said space and a reservoir for said fluid;

d. filling said space and that portion of said reservoir below a predetermined level with said fluid; and e. detecting the presence of water in said space by observation of said fluid reaching a level in said reservoir above said predetermined level.

9. A process in accordance with claim 8 wherein said casing is generally cylindrical and said space is generally annular.

10. A process in accordance with claim 8 further comprising the step of:

removing water from said space and said reservoir by drawing off water floating on top of said fluid in said reservoir.

11. A process in accordance with claim 8 further comprising the step of:

detecting the presence of hydraulic fluid in said space by the observation of said fluid reaching a level in said reservoir above said pre-determined level and drawing off hydraulic fluid floating on top of said fluid in said reservoir.

12. A process in accordance with claim 8, wherein said detecting step includes compensating for normal expected variation in fluid level resulting from thermal expansion.

13. A process in accordance with claim 8 wherein said biogenic corrosion is caused by the presence of microorganisms in said water and wherein said fluid is biocidal.

14. A process in accordance with claim 8 wherein said fluid comprises an oil-based aqueous emulsion.

15. A process in accordance with claim 8 wherein said fluid comprises a clay-based aqueous emulsion.

16. A process in accordance with claim 8 wherein said fluid comprises an oil-based aqueous suspension.

17. A process in accordance with claim 8 wherein said fluid is dielectric.

18. A process in accordance with claim 8 wherein said fluid comprises a clay-based aqueous suspension.

19. A process for protecting a hydraulic cylinder having a surface exposed to an underground environment against corrosion, comprising the steps of:

a. enclosing said cylinder surface exposed to said environment within a casing with a space between said cylinder surface and said casing;

b. substantially filling said space with a thixotropic dielectric hydrophobic fluid which retains a gel structure when static, has a specific gravity greater than water and inhibits said corrosion;

providing a fluid conduit between said space and a reservoir for said fluid;

d. filling said space and that portion of said reservoir below a predetermined level with said fluid; and e. detecting the presence of water or hydraulic fluid in said space by the observation of said fluid reaching a level in said reservoir above said pre-determined level; and f. removing water or hydraulic fluid from said space and said reservoir by drawing off water or hydraulic fluid floating on top of said fluid in said reservoir.

20. Apparatus for preventing corrosion of a metal cylinder having a surface exposed to an underground environment, comprising;

a casing surrounding said surface of said cylinder and spaced apart therefrom, with a space formed between said casing and said cylinder;

a corrosion inhibiting fluid filling said space;

means for detecting the incursion of water into said fluid within said space; and means for removal of said water from said space.

21. Apparatus in accordance with claim 20 further comprising means for detecting the incursion of hydraulic fluid into said fluid within said space and means for removal of said hydraulic fluid from said space.

22. Apparatus for protecting a hydraulic cylinder having a surface exposed to an underground environment against biogenic, galvanic and aqueous corrosion, comprising:

a casing enclosing said cylinder surface exposed to said environment and forming a space between said cylinder surface and said casing;

a thixotropic hydrophobic dielectric fluid which retains a gel structure when static, has a specific gravity greater than water and inhibits said corrosion, a reservoir for said fluid, and a fluid conduit providing fluid communication between said space and said reservoir, said fluid filling said space and said conduit and partially filling said reservoir to a predetermined level; and means for detecting the presence of water or hydraulic fluid in said space comprising means to observe the surface of said fluid reaching a level in said reservoir above said predetermined level, said observation thereby indicating the presence of water or hydraulic fluid in addition to said fluid in said space.

23. Apparatus in accordance with claim 22 further comprising means to seal said casing.

24. Apparatus in accordance with claim 22 wherein said casing is generally cylindrical and said space is generally annular.

25. Apparatus in accordance with claim 23 wherein said sealing means comprises a sealing member at each axial end of said casing.

26. Apparatus in accordance with claim 22 further comprising means for removing water or hydraulic fluid from said space and said reservoir by drawing off water or hydraulic fluid floating on top of said fluid in said reservoir.

27. Apparatus in accordance with claim 22, wherein said means for detecting includes means for compensating for normal expected variation in fluid level resulting from thermal expansion.

28. Apparatus in accordance with claim 22 further comprising a movable elevator driving ram seated within said cylinder and extending outwardly from one axial end thereof, and hydraulic means to reciprocate said ram within said cylinder and thereby raise and lower an elevator car attached to said ram.

29. Apparatus in accordance with claim 28 wherein said casing is generally cylindrical, said space is generally annular, and further comprising means for sealing at each axial end of said casing, said sealing means at a first axial end of said casing distal from said extended ram comprising a cap and said sealing means at a second axial end of said casing adjacent to said extended ram comprising a ring seal and clamping means closing that portion of said space between said casing and said cylinder adjacent said second axial end.

30. Apparatus in accordance with claim 22 wherein said conduit is flexible.

31. Apparatus in accordance with claim 22 wherein said space has a width on the order of 0.50 to 0.75 in. (13 to 19 mm).

32. Apparatus in accordance with claim 22 further comprising means to inject said fluid into said space.

33. Apparatus for preventing corrosion of a metal cylinder having a surface exposed to an underground environment, comprising;

a casing surrounding said surface of said cylinder and spaced apart therefrom, with a space formed between said casing and said cylinder;

a corrosion inhibiting fluid filling said space;

means for detecting the incursion of a different fluid into said fluid within said space; and means for removal of said different fluid from said space.

34. A process for protecting a hydraulic cylinder having a surface exposed to an underground environment against biogenic and aqueous corrosion, comprising the steps of:

a. enclosing said cylinder surface exposed to said environment within a casing with a space between said cylinder surface and said casing;

b. substantially filling said space with a thixotropic hydrophobic fluid which retains a gel structure when static, has a specific gravity greater than water and inhibits said corrosion;

c. providing a fluid conduit between said space and a reservoir for said fluid;

d. filling said space and that portion of said reservoir below a predetermined level with said fluid; and e. detecting the presence of a different fluid in said space by observation of said thixotropic hydrophobic fluid reaching a level in said reservoir above said predetermined level.

* * * * *